US005470071A

United States Patent [19]

Hsu et al.

[11] Patent Number: 5,470,071

[45] Date of Patent: Nov. 28, 1995

[54] GOLF SWING TRAINING DEVICE

[76] Inventors: Kevin Hsu; Chun S. Lin, both of 11610 Inwood, Houston, Tex. 77077

[21] Appl. No.: 307,078

[22] Filed: Sep. 16, 1994

[51] Int. Cl.[6] ..... A63B 69/36

[52] U.S. Cl. ..... 273/186.4; 273/194 A

[58] Field of Search ..... 273/32 R, 35 R, 273/183.1, 186.4, 187.4, 194 R, 194 A, 167 H, 457; 446/267, 15; 472/52

[56] References Cited

U.S. PATENT DOCUMENTS

| | | | |
|---|---|---|---|
| 2,804,306 | 8/1957 | Chedizter et al. | 273/186.4 |
| 3,350,101 | 10/1967 | Bishop et al. | 273/186 |
| 3,958,362 | 5/1976 | Kessler | 446/15 |
| 3,992,012 | 11/1976 | Campbell | 273/186 R |
| 4,693,479 | 9/1987 | McGuire | 273/186 A |
| 4,911,450 | 3/1990 | Rabold | 273/186 A |
| 5,165,683 | 11/1992 | Beutler et al. | 273/35 R |
| 5,210,603 | 5/1993 | Sabin | 358/93 |
| 5,236,192 | 8/1993 | Pitzel | 273/186.2 |
| 5,273,278 | 12/1993 | Becker | 273/29 A |
| 5,297,796 | 3/1994 | Peterson | 273/183.1 |

*Primary Examiner*—Vincent Millin
*Assistant Examiner*—William M. Pierce
*Attorney, Agent, or Firm*—Harrison & Egbert

[57] ABSTRACT

A golf swing training device comprising a shaft and a club head connected to an end of the shaft. The club head has a liquid-receiving chamber formed therein. This chamber has an inlet and an outlet orifice. The outlet orifice is of a sufficient size so as to release a liquid during a swing of said shaft. The outlet orifice opens at the bottom of the club head. The inlet is positioned at the top of the club head. A liquid can be contained within the chamber, such as water or a colored chemical. The orifice should have a diameter of between 1/32 and 1/256 of an inch. The club head can be in the shape of an iron or a driver.

17 Claims, 3 Drawing Sheets

GOLF SWING TRAINING DEVICE

TECHNICAL FIELD

The present invention is related in general to the field of golf swing practice and training devices. More particularly, the present invention is related to golf swing training devices that allow the golfer to almost instantaneously evaluate his or her swing.

BACKGROUND ART

Golfers continuously strive for the perfect swing to achieve an accurate and powerful drive that sends the ball a long distance in a straight line toward the target green or hole. To realize this goal, golfers typically engage in practice and exercise sessions to improve their technique and to increase the strength and muscle memory used in various techniques. Golfers may simply practice their swings in the back yard or they may utilize a place designed especially for practicing, such as a driving range. Similarly, they may simply practice with their regular golf clubs or they may use some sort of club or other device specially designed for practice and exercise. A wide variety of devices have been developed for the purpose of training the golf swing of the golfer.

In the past, various patents have issued relating to devices for training the swing of a golfer. U.S. Pat. No. 3,350,101 issued on Oct. 31, 1967, to Bishop et al. teaches a golf swing practice device having a pad with a tee area and a simulated captive ball member therein. A curved line represents the ground trace of the swing of the club extending to the tee area. A resilient upright member is wound on a reel for vertical adjustment located along this line and represents a vertical point on the swing path of the club.

U.S. Pat. No. 3,992,012, issued on Nov. 16, 1976, to I. R. Campbell describes a device for analyzing the swing of a golf club. This device has a base with a ball support area. Side spin detectors are located above the base with their free ends adjacent the ball support area for contact by a club head as it passes over the ball support area in a swing.

U.S. Pat. No. 4,693,479, issued on Sep. 15, 1987, to R. P. McGwire describes a self-contained detachable device for selective attachment to a golf club to provide a visual indication of the position of the golf club during the swing. A cylindrical housing, which has a light bulb attached thereto, provides a directed beam of light extending outwardly from the housing. The light beam provides illumination of a well-defined path over the surface surrounding the golf ball during the back swing and the forward swing.

U.S. Pat. No. 4,911,450, issued on Mar. 27, 1990, to B. Rabold shows a device used to teach and practice a golf swing. This device includes a short shaft having a club head on one end and a grip on the other end. A grip end light is mounted in the grip to produce a light that is co-linear with the longitudinal axis of the shaft. A club head light is mounted in the club head to provide a light that is directly below the club head bottom edge and is oriented at ninety degrees to the bottom edge of the club head so that the club head light is located centrally between the heel and toe directly beneath the club head. A swing track includes paths to be traversed by the grip end light and the club head light during the various phases of the golf swing.

U.S. Pat. No. 5,165,683, issued on Nov. 24, 1992, to Beutler et al. shows a golf swing training device that includes a blade having a sufficient width and rigidity to generate air resistance during a representative swing motion. This blade is designed to fold during the upswing motion and to flatten during the downswing motion.

U.S. Pat. No. 5,210,603, issued on May 11, 1993, to D. C. Sabin provides a portable battery-operated video camera and recorder system that allows one to make a video recording of a golf swing.

U.S. Pat. No. 5,236,192, issued on Aug. 17, 1993, to B. H. Pitzel shows a golf swing training device that comprises a club shaft, one end having a grip and the other end having a generally U-shaped member to which a removable flat panel is attached. The training club is swung like a standard club and is used to simulate striking a ball with a square face, without the use of a golf ball. Because of its size, the panel provides a visible indication of the position of the club in the hands of the user so as to allow the user to make immediate adjustments in the course of the swing.

U.S. Pat. No. 5,273,278, issued on Dec. 28, 1993, to R. Becker describes a golf club having an audio feedback device to provide an audible indication of the speed of movement of the club.

U.S. Pat. No. 5,297,796, issued on Mar. 29, 1994, to J. R. Peterson discloses a visual monitoring system for a golfer to simultaneously watch his golf swing while the swing is being made. One or more video cameras and video monitoring screens are mounted below a transparent surface where the swing is being made with a golf club for viewing the swing without distorting the head of the golfer during the golf swing.

It is an object of the present invention to provide a golf swing training device that provides immediate feedback of the swing path.

It is another object of the present invention to provide a golf swing training device that enhances the ability of the golfer to correct his or her swing by comparing the swing to an ideal swing path.

It is another object of the present invention to provide a golf swing training device that enhances the "muscle memory" of the golfer.

It is another object of the present invention to provide a golf swing training device that is portable, easy to use, economical, and suitable for indoor and/or outdoor practice.

It is a further object of the present invention to provide a golf swing training device that reduces the need for golfing instructors.

These and other objects and advantages of the present invention will become apparent from a reading of the attached specification and appended claims.

SUMMARY OF THE INVENTION

The present invention is a golf swing training device that comprises a shaft, and a club head connected to an end of the shaft. The club head has a liquid-receiving chamber thereon. The chamber has an inlet and an outlet orifice. The outlet orifice is of a sufficient size so as to release a liquid during a swing of the shaft.

In one embodiment of the present invention, the chamber is formed in an interior of the club head. The orifice opens at a bottom of the club head. The inlet is positioned at the top of the club head. The club head can either have the shape of an iron or a driver. The club head can be either for left-handed or for right-handed golfers. Preferably, the orifice has a diameter of between 1/32 and 1/256 of an inch. The chamber can contain a liquid contained therein. This liquid can be water or a colored chemical.

In another embodiment of the present invention, the chamber is threadedly affixed to the club head. The club head has a driving surface for contacting a golf ball. The chamber is affixed to an opposite side of the club head from the driving surface. In another alternative embodiment of the present invention, the chamber is removable from the club head and is secured to the club head with a plurality of band members. The club head has a hosel connected to the shaft. At least one of the band members extends around the chamber and the hosel. The club head has a driving surface thereon. At least one of the band members extends around this driving surface and the chamber.

DETAILED DESCRIPTION OF THE INVENTION

Figure 1:
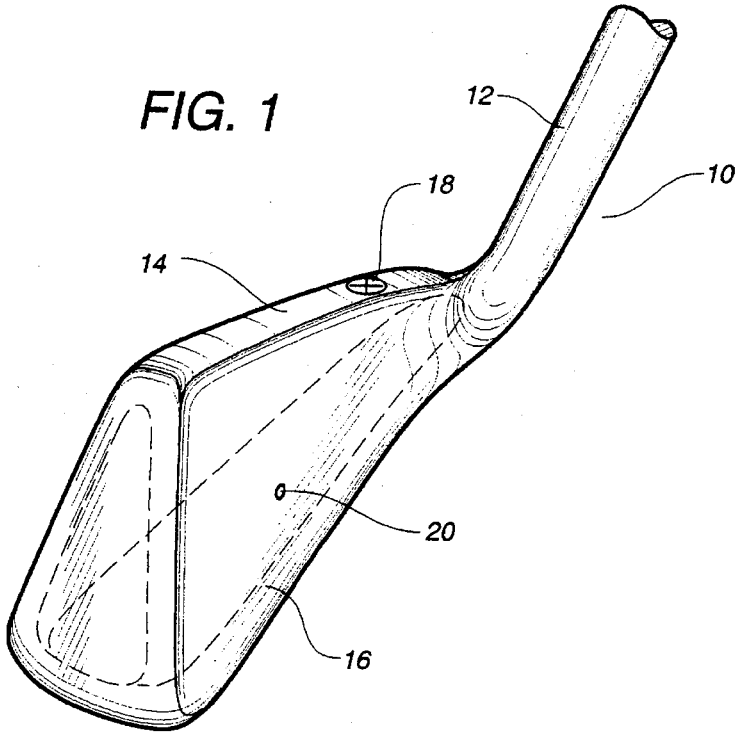
FIG. 1 is a perspective view of the golf swing training device of the present invention.

In FIG. 1, there is shown at 10 the golf swing training device in accordance with the preferred embodiment of the present invention. The golf swing training device 10 includes a shaft 12 and a club head 14. The club head 14 is connected to an end of the shaft 12. The club head has a liquid-receiving chamber 16 therein. The chamber 16 has an inlet 18 and an outlet orifice 20. The outlet orifice 20 is of a sufficient size so as to release a liquid during the swing of the shaft 12 by a golfer.

In FIG. 1, it can be seen that the club head 14 is configured in the shape of an iron club. The chamber 16 is formed on the interior of the club head 14. The orifice 20 opens at the bottom of the club head. The inlet 18 is positioned at the top of the club head. The orifice 20 should have a diameter of between 1/32 and 1/256 of an inch.

In normal use, the inlet 18 can be opened so as to allow the user to introduce a liquid into the chamber 16 of the club head 14. The inlet 18 can be closed with a stopper or another suitable closure device. The liquid can be either water or a colored chemical. Water should be used where a staining action of a chemical should not be used. The colored chemical can provide a more vivid display of the swing pattern. The orifice 20 is particularly sized such that water will drip therethrough. In particular, during the swinging of the shaft 12, the centrifugal force imparted upon the liquid within the chamber 16 will cause drops of water to escape through the orifice 20. Ideally, the orifice 20 should be small enough so that water does not escape from the chamber 16 when the shaft 12 is stationary.

Figure 2:
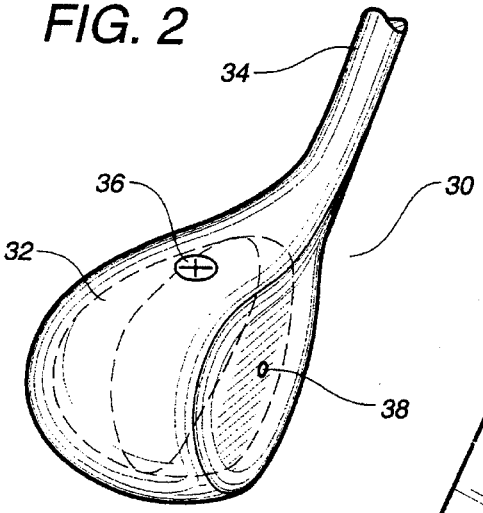
FIG. 2 is a perspective view of the golf swing training device of the present invention as used on a driver head.

FIG. 2 shows the golf swing training device 30 in the form of a wood or a driver. This embodiment is virtually identical to that of FIG. 1 except that the club head 32 is configured in the shape of the driver. The shaft 34 is connected at one end to the driver club head 32. An inlet 36 and an outlet orifice 38 are provided in the manner described in FIG. 1. In relation to FIGS. 1 and 2, the golfer can use either the training device 10 or 30 depending upon whether the golfer wishes to practice with the golfing iron or with the golfing driver.

Figure 3:
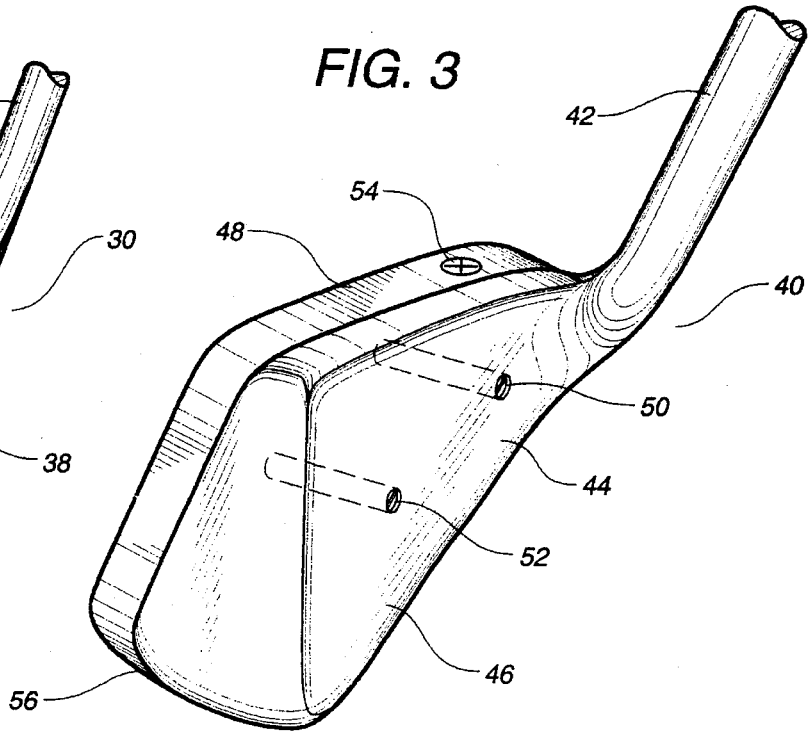
FIG. 3 is a perspective view of a first alternative embodiment of the golf swing training device of the present invention.

FIG. 3 shows an alternative embodiment of the present invention. The golf swing training device 40 includes a shaft 42 and a club head 44. The club head 44 has a driver surface 46 that is used to contact a golf ball during the swing. The liquid-receiving chamber 48 is positioned on the opposite surface of the club head 44 from the driving surface 46. Threaded members 50 and 52 extend into the club head 44 so as to properly secure the liquid-receiving chamber 48 to the back surface of the club head 44. The chamber 48 includes an inlet 54 along its top surface. A small outlet orifice, configured in the manner of outlet orifice 20 of FIG. 1 or the outlet orifice 38 of FIG. 2, is provided on the bottom surface 56 of the chamber 48.

The golf swing training device 40 is particularly appropriate when the expense of forming the liquid-receiving chamber on the interior of the club head 44 is not desired. The manufacturing costs for the device 40 is less than that of the embodiments of FIGS. 1 and 2. The liquid-receiving chamber 48 can simply be attached by screwing or unscrewing the threaded members 50 and 52.

Figure 4:
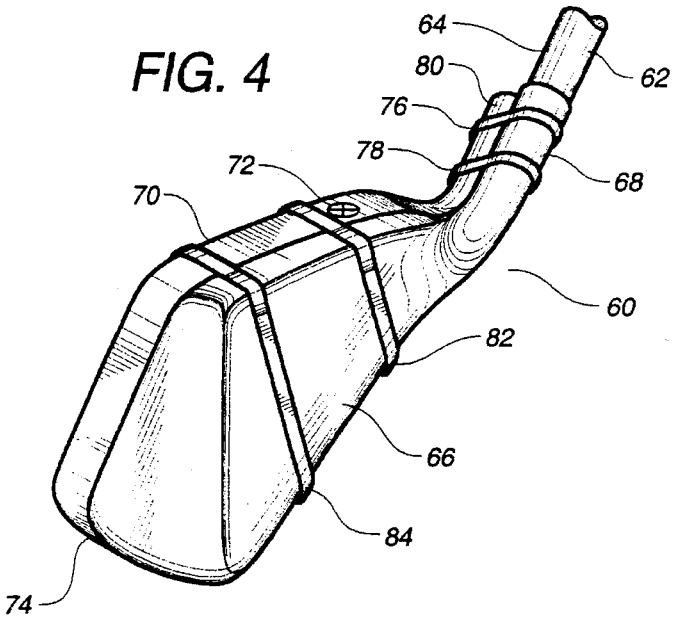
FIG. 4 is a perspective view of a second alternative embodiment of the golf swing training device of the present invention.

FIG. 4 shows another alternative embodiment of the golf swing training device 60 of the present invention. The golf swing training device 60 is configured so as to allow the device to be retrofitted to existing golf club 62. The existing golf club has a shaft 64 and a club head 66. A hosel 68 allows the shaft 64 to be connected to the club head 66. The chamber 70 has a configuration generally matching the configuration of the club head 66 and the hosel 68. The chamber 68 includes an inlet 72 and an outlet located at the bottom 74 of the chamber 70. A first band member 76 and a second band member 78 serve to affix an upward extension 80 of the chamber 70 to the hosel 68 of the club head 66. Band members 76 and 78 extend around the upward extension 80 and the hosel 78 so as to secure the chamber 70 to this portion of the golf club 62. Similarly, band members 82 and 84 extend around the body of the chamber 70 and across the driving surface of the club head 66. Band members 82 and 84 serve to secure the body of the chamber 70 to the back surface of the club head 66.

Figure 5:
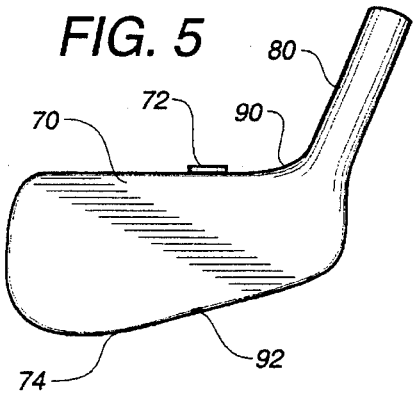
FIG. 5 is a side elevational view of the chamber used on the embodiment of FIG. 4.

FIG. 5 shows the configuration of the chamber 70. It can be seen that the chamber 70 has the inlet 72 positioned on the top surface 90. The outlet orifice 92 is positioned on the bottom surface 74. The body of the chamber 70 has a configuration resembling that of the club head 66. The upward extension 80 is angled and configured to be aligned with the hosel 68 of the golf club 62.

Figure 6:
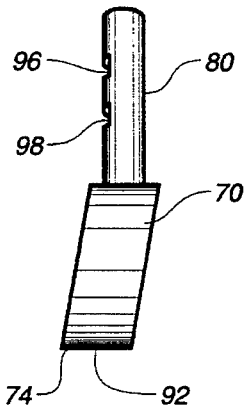
FIG. 6 is an end view of the chamber of the embodiment of FIG. 4.

Importantly, it can be seen in FIG. 6 that the upward extension 80 has a pair of indentations 96 and 98 extending thereinto. The indentations 96 and 98 serve to properly receive the edges of the band members 76 and 78 so as to provide a secure fit between the band members 76 and 78 and the upward extension 80. The chamber 70 has a generally rectangular cross-section. The outlet orifice 92 is positioned at the bottom surface 74 of the chamber 70.

Figure 7:
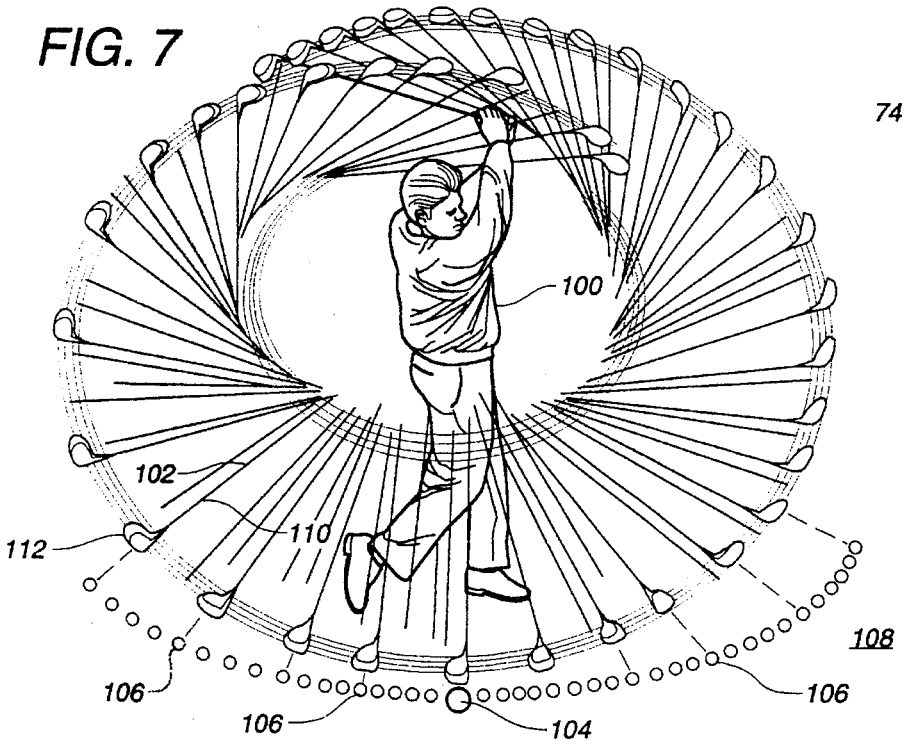
FIG. 7 is a diagrammatic view of the golfer using the golf swing training device of the present invention.

FIG. 7 illustrates a golfer 100 utilizing the golf swing training device 102 of the present invention. Initially, the golfer has a golf ball or a simulated golf ball 104 positioned in front of the golfer 100. When the golfer swings the golf swing training device 102, droplets 106 will be distributed across the surface of the earth (or a mat) 108 in accordance with the path of the swing of the golf swing training device 102. The centrifugal force imparted by the swinging of the shaft 110 of the golf swing training device 102 will cause the droplets 106 to be emitted through the outlet orifice of the chamber at the club head 112.

After an initial swing, the golfer 100 is able to see the path of his or her swing. The pattern of droplets 106 will be clearly visible to the golfer 100. At this point, the golfer can evaluate the desired swing or can evaluate how to correct the swing. When the golfer 100 takes another swing, the golfer will be able to easily compare the droplets emitted through the second swing with the droplets 106 that were emitted during the first swing. As such, the golfer can accurately compare swing motions. This comparison can be carried out in an immediate fashion. A golf ball symbol marker 134 is provided on the surface 132. An ideal swing path 136 is represented by a fabric having a different color than that of the golf ball marker 134 and the surface 132.

Figure 8:
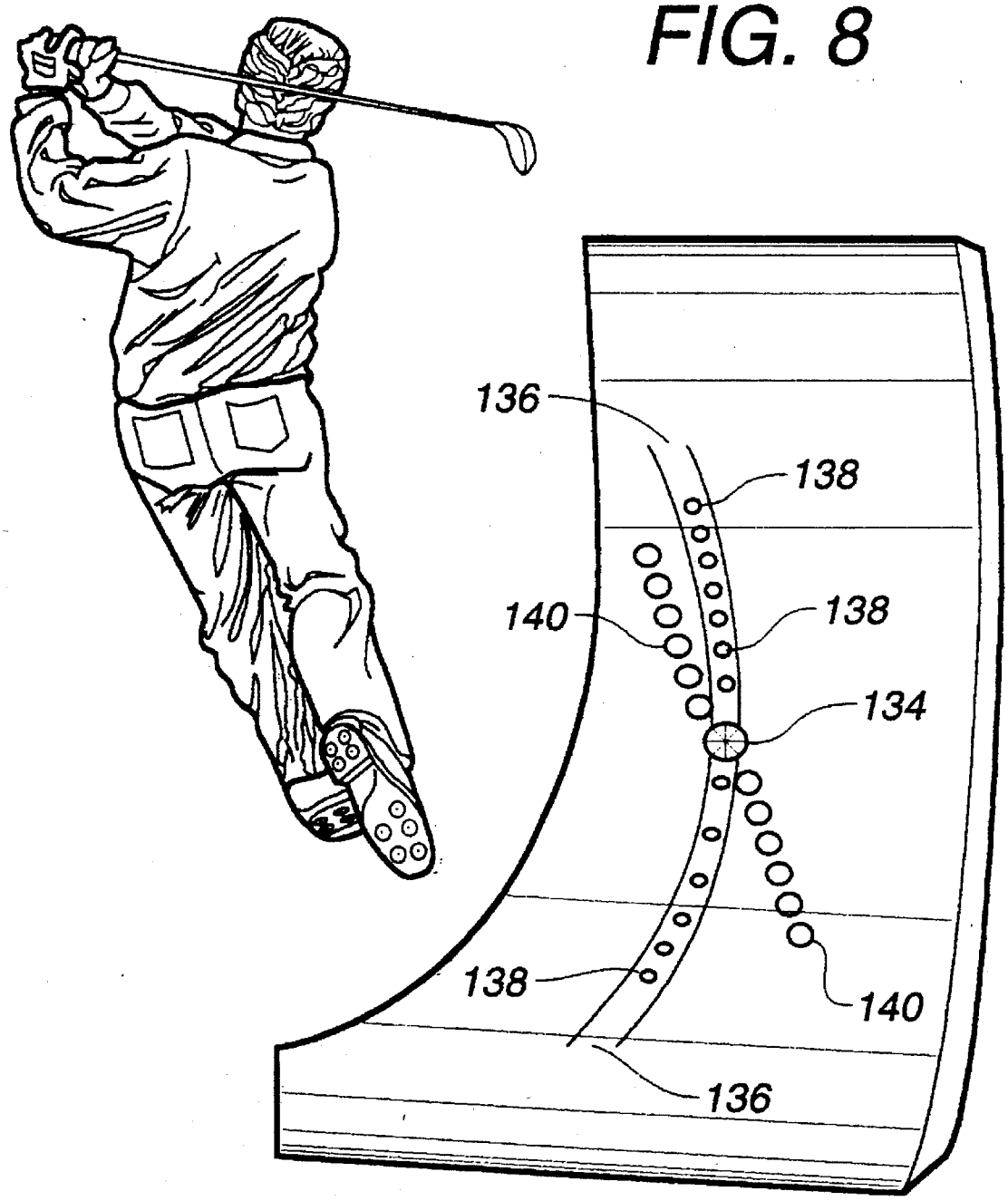
FIG. 8 is a plan view of a practice mat upon which the present invention can be used.

In FIG. 8, it can be seen that the water droplets 138 extend along the ideal swing path fabric 136. In FIG. 8, it can be seen that an improper swing path was carried out. This improper swing path is illustrated by the droplets 140. Various advanced swing training paths, of different colors than those shown before, can be included with the mat 130. Additionally, a superimposed transparent grid board can be used so as to check the degree of offset on each swing. As such, the mat 130 can be used so as to facilitate the display and training of the golfer's swing.

The foregoing disclosure and description of the invention is illustrative and explanatory thereof. Various changes in the details of the illustrated configuration may be made within the scope of the appended claims without departing from the true spirit of the invention. The present invention should only be limited by the following claims and their legal equivalents.

I claim:

1. A golf swing training device comprising:

a shaft; and a club head connected to an end of said shaft, said club head having a liquid-receiving chamber, said chamber having an inlet and an outlet orifice, said outlet orifice of a sufficient size to release a liquid during a swing of said, shaft, said chamber being secured to said club head with a plurality of band members, said club head having a hosel connected to said shaft, at least one of said band members extending around said chamber and said hosel, said club head having a driving surface thereon, at least one of said band members extending around said driving chamber and said driving surface of said club head.

2. The device of claim 1, said chamber formed in an interior of said club head, said orifice opening at a bottom of said club head.

3. The device of claim 2, said inlet positioned at a top of said club head.

4. The device of claim 1, said club head having an iron shape.

5. The device of claim 1, said club head having a driver shape.

6. The device of claim 1, said orifice having a diameter of between 1/32 and 1/256 of an inch.

7. The device of claim 1, further comprising:

a liquid contained within said chamber.

8. The device of claim 7, said liquid being water or a colorless chemical.

9. The device of claim 7, said liquid being a colored chemical.

10. The device of claim 1, said chamber being threadedly affixed to said club head.

11. The device of claim 10, said club head having a driving surface for contacting a golf ball, said chamber affixed to an opposite surface of said club head from said driving surface.

12. The device of claim 1, said chamber having an upward extension, said upward extension having an indentation formed therein, said band member received within said indentation.

13. A golf swing training device comprising:

a chamber having an inlet and an outlet orifice, said outlet orifice having a size suitable for allowing drops of liquid to pass therethrough, said outlet orifice positioned at a bottom of said chamber; and a means for attaching said chamber to a surface of a club head, said means for attaching comprising a plurality of band members, at least one of said band members extending around said chamber and a hosel of said club head, said club head having a driving surface thereon, at least one of said band members extending around said chamber and said driving surface of said club head.

14. The device of claim 13, further comprising:

a liquid filling at least a portion of said chamber.

15. The device of claim 15, said outlet orifice having a diameter of between 1/32 and 1/256 of an inch.

16. The device of claim 13, said chamber having an upward extension, said upward extension having a pair of indentations formed therein, said band members received within said indentation and extending around said hosel.

17. The device of claim 16, said chamber having a configuration of a similar shape as a club head.

* * * * *